United States Patent [19]

Levine

[11] B 4,000,697

[45] Jan. 4, 1977

[54] MECHANICAL RETENTION SYSTEM FOR USE WITH CASELESS AMMUNITION

[75] Inventor: Seymour Levine, Chicago, Ill.

[73] Assignee: The United States of America as represented by the Secretary of the Air Force, Washington, D.C.

[22] Filed: Aug. 10, 1972

[21] Appl. No.: 279,415

[44] Published under the second Trial Voluntary Protest Program on March 16, 1976 as document No. B 279,415.

[52] U.S. Cl. ..... 102/38; 102/DIG. 1

[51] Int. Cl.[2] ..... F42B 5/02

[58] Field of Search ..... 102/38, 40, 43, DIG. 1

[56] References Cited

UNITED STATES PATENTS

| | | | |
|---|---|---|---|
| 2,663,259 | 12/1953 | Catlin et al. | 102/38 |
| 3,048,849 | 8/1962 | De Caro et al. | 102/40 |
| 3,288,066 | 11/1966 | Stadler et al. | 102/38 |
| 3,345,945 | 10/1967 | Quinlan et al. | 102/DIG. 1 |
| 3,482,516 | 12/1969 | Farmer et al. | 102/38 |
| 3,658,008 | 4/1972 | Larson | 102/DIG. 1 |
| 3,688,697 | 9/1972 | Paul et al. | 102/DIG. 1 |
| 3,696,749 | 10/1972 | Scanlon | 102/DIG. 1 |

*Primary Examiner*—Samuel W. Engle
*Assistant Examiner*—Harold Tudor
*Attorney, Agent, or Firm*—Joseph E. Rusz; Arsen Tashjian

[57] ABSTRACT

An internally threaded igniter tube is threadably attached to a boss on the projectile base. In order to withstand ramming, a diametral flange at the base of the round engages a shoulder on the propellant so that when the igniter is in the assembled position, the mid-section area is loaded in tension while the forward threaded section is loaded in shear. This arrangement produces superior ballistic properties by permitting the ballistic shot-start to be low enough to insure early motion while at the same time having the ability to withstand relatively high impact loads.

3 Claims, 1 Drawing Figure

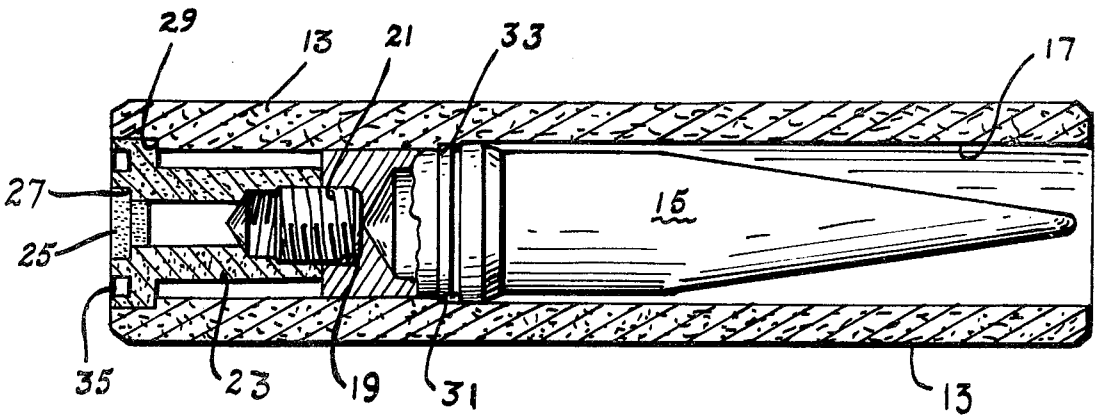
17
33
21
13
29
27
25
35
23
19
31
13
16

MECHANICAL RETENTION SYSTEM FOR USE WITH CASELESS AMMUNITION

BACKGROUND OF THE INVENTION

This invention relates to a totally mechanical retention system for projectiles telescoped within fully combustible cartridges and, more particularly, the invention is concerned with providing a threaded end igniter tube which would effectively eliminate shot-start inconsistencies arising from lack of bond uniformity. The assembled cartridge has low ballistic shot-start and yet is well capable of withstanding ramming loads as a result of the unique manner in which the igniter tube is attached to the base of the round.

Caseless ammunition has long been recognized as the most advantageous means for improving the firepower and performance of high speed automatic weapons. The elimination of the need for extraction and ejection of spent cartridge cases makes the higher firing rates possible. Also, the caseless type ammunition is light in weight and easier to transport and the problem of disposing of spent cartridge cases is eliminated.

One of the major problems in the development of caseless ammunition has been the poor reliability of the caseless round. This is primarily a result of the igniter tube and the means for attaching it to the projectile. Heretofore, the conventional system for installing the igniter has been by the use of epoxy cement alone. The bond thus produced has been quite inconsistent, that is, in one round it may be too weak while in another round it may be too strong. This results in a condition where, in the first instance, the bond may be so weak that it fails under ordinary ramming impact force while, in the second instance, it may be so strong that the ballistic shot-start is too high to insure early motion. Thus, it would be most desirable and a step forward in the art to provide an igniter retention system for caseless ammunition wherein the above-mentioned inconsistencies are eliminated by attaching the igniter to the projectile in such a manner that a consistently reliable round of ammunition results thereby producing a far more efficient weapon having much more effective firepower.

SUMMARY OF THE INVENTION

The present invention is concerned with providing a system for threadably attaching the igniter tube to the base of the projectile in a caseless cartridge so that a completely reliable assembly is produced wherein the bond is consistently strong enough to withstand ramming forces while, at the same time, the ballistic shot-start is low enough to insure early motion.

Accordingly, it is an object of the present invention to provide an improved fastening means for attaching the igniter tube to the base of a projectile telescoped within a combustible and consumable cartridge case.

Another object of the invention is to provide a totally mechanical retention system for a caseless cartridge wherein the igniter tube is threadably attached to the base of a projectile to produce consistently uniform ballistic shot-starts as well as to maintain the elements in position during the ramming operation.

Still another object of the invention is to provide an igniter tube having an internally threaded end portion which engages a boss on the projectile. This arrangement loads the midsection area of the igniter in tension and the forward section through the threads in shear.

A further object of the invention is to provide a mechanical retention system for use with a caseless cartridge wherein the igniter is threadably fastened to the projectile to produce a bond which is consistently strong enough to withstand ramming loads and yet of low strength so as not to retard early motion.

A still further object of the invention is to provide a system for the mechanical retention of a telescoped cartridge wherein quick opening effects are achieved by the internal pressurization of the igniter tube very early in the ballistic cycle. This feature is accomplished along with the ability of the cartridge to withstand relatively high ramming loads.

These and other objects, features, and advantages will become more apparent after considering the following detailed description taken in conjunction with the annexed drawings and appended claims.

BRIEF DESCRIPTION OF THE DRAWING

The drawing is a view in cross section partially broken away showing the threadably attached igniter tube at the base of the projectile in a caseless cartridge according to the invention.

DESCRIPTION OF A PREFERRED EMBODIMENT

Referring now to the drawing, the hereinafter disclosed mechanical retention system for use with caseless ammunition includes a telescoped round of ammunition wherein a propellant charge 13, which is generally cylindrical in configuration, has a projectile 15 positioned within the axial bore 17 thereof. The projectile 15 is provided with a threaded axial recess 19 in the center of its base portion. A set screw 21 threadably engages the recess 19 and is threaded thereinto being preferably fixed with epoxy cement to prevent loosening. A portion of the set screw 21 extends aft beyond the base of the projectile 15 thereby, in effect, forming a threaded boss on the base of the projectile 15. Of course, if desired, the set screw 21 could be made integral with the projectile 15 by machining a threaded boss on the base thereof.

A tubular igniter 23 is positioned in the rearwardmost part of the axial bore 17 and includes a threaded forward section for engaging the threads on the set screw 21. Within the bore of the tubular igniter 23 at the base thereof, a shoulder is formed so that a primer 25 can be positioned in the central base portion of the cartridge. The igniter tube 23 operatively supports the primer 25 so that that the cartridge can be fired by the crushing action of a firing pin (not shown). The support is achieved by providing a shoulder 27 in the igniter 23 which engages the primer 25 and another shoulder 29 operates to prevent the igniter from moving forward upon firing pin impact.

When the telescoped round is assembled, the projectile 15 is inserted base downward into the axial bore 17 of the propellant charge 13. A diametral flange 31 on the projectile 15 engages a shoulder 33 on the internal surface of the propellant charge 13 and stops further downward movement. The igniter tube 23 is then threadably attached to the set screw 21 which had previously been fixedly positioned on the base of the projectile 15. The igniter tube 23 is tightened in position by using a spanner-type wrench which fits into the openings 35 in the base of the igniter tube 23. The operation of turning the igniter tube 23 causes the diametral flange 31 of the projectile 15 to be drawn against the shoulder 33 while the base portion of the igniter tube is pressed against the shoulder 29 locking all of the elements in position. This procedure effectively loads the central portion of the igniter 23 in tension and the forward section through the threads are loaded in shear to produce a stress pattern which is well able to withstand ramming. At the same time, quick opening effects are achieved by the internal pressurization of the igniter tube 23 very early in the ballistic cycle.

In accordance with the invention, the propellant charge can be prepared from single, double or triple base or from composite granules. Generally, the charge is made by a molding technique wherein small granules of propellant are bonded together by a suitable binder. This technique is practiced by filling a mold with granules of propellant, adding a binder and pressurizing the mold to a suitable pressure for the proper time. The charge is then removed from the mold and dried. A suitable binder for most propellants would be a mixture of collodian and acetone.

A combustible primer is preferably utilized in the invention and can consist of a standard prepared primer wherein the body is made from propellant or other combustible material. The priming mixture would contain the usual ingredients such as potassium chlorate, antimony sulfide, lead sulphocyanide, trinitrotoluol or other standard primer materials. The exact composition and amount of priming mixture will depend on the formulation and size of the igniter and propellant charge. Greater reliability in the initial motion of the projectile of the cartridge hereinbefore disclosed can be attributed to improved ignition with the closed end igniter tube and less tendency of blowing out black powder.

Although the invention has been illustrated in terms of a preferred embodiment thereof, the invention is not limited to this embodiment or to the preferred configuration mentioned. For example, it will be apparent to those skilled in the art that my invention can be practiced by machining or otherwise forming a threaded boss on the rearwardmost end of the projectile 15 and attaching the igniter tube 23 directly thereto, thereby eliminating the need for using the set screw 21. Also, it should be understood that various changes, alterations, modifications and substitutions, particularly with respect to the construction details can be made in the arrangement of the several elements without departing from the true spirit and scope of the appended claims.

Having thus described my invention, what I claim and desire to secure by Letters Patent of the United States is:

1. A telescoped round of caseless ammunition comprising, a propellant charge of substantially cylindrical configuration and having an axial bore therethrough, said propellant charge having a forward portion and a rearward portion, a projectile positioned in the forward portion of and completely within the bore of said propellant charge, a tubular igniter positioned in the rearward portion of said propellant charge immediately aft of said projectile, means for threadably connecting said tubular igniter to the base of said projectile, and a primer disposed within the rearwardmost portion of said igniter, said primer being in operative engagement with a shoulder on said igniter to support and effectively prevent forward movement of said primer upon firing pin impact.

2. The telescoped round of caseless ammunition defined in claim 1 wherein said means for threadably connecting said igniter to said projectile includes a threaded boss extending rearwardly from the base of said projectile for engagement with threads in the forward internal portion of said tubular igniter.

3. The telescoped round of caseless ammunition defined in claim 2 wherein a pair of spaced shoulders, one forward and one aft, are disposed on the inner surface of the cylindrical propellant charge, the forward shoulder engaging a diametral flange on the projectile and the aft shoulder engaging said igniter such that the threading of said igniter on the base of the projectile loads the body of said igniter in tension.

* * * * *